US010100796B2

(12) United States Patent
Graspeuntner

(10) Patent No.: US 10,100,796 B2
(45) Date of Patent: Oct. 16, 2018

(54) RECIPROCATING PUMP

(71) Applicant: Robert Bosch GmbH, Stuttgart (DE)

(72) Inventor: Christian Graspeuntner, Hallein (AT)

(73) Assignee: Robert Bosch GmbH, Stuttgart (DE)

( * ) Notice: Subject to any disclaimer, the term of this patent is extended or adjusted under 35 U.S.C. 154(b) by 20 days.

(21) Appl. No.: 15/511,295

(22) PCT Filed: Jul. 14, 2015

(86) PCT No.: PCT/EP2015/066068
§ 371 (c)(1),
(2) Date: Mar. 15, 2017

(87) PCT Pub. No.: WO2016/041655
PCT Pub. Date: Mar. 24, 2016

(65) Prior Publication Data

US 2017/0260947 A1 Sep. 14, 2017

(30) Foreign Application Priority Data

Sep. 15, 2014 (DE) ..... 10 2014 218 489

(51) Int. Cl.
*F02M 59/10* (2006.01)
*F04B 1/04* (2006.01)
(Continued)

(52) U.S. Cl.
CPC ..... *F02M 59/102* (2013.01); *F04B 1/0408* (2013.01); *F04B 1/0417* (2013.01); *F04B 1/0426* (2013.01); *F04B 9/042* (2013.01); *F04B 15/00* (2013.01); *F04B 17/05* (2013.01); *F05C 2251/02* (2013.01)

(58) Field of Classification Search
CPC ..... F02M 59/10; F02M 59/102; F04B 9/042; F04B 15/00; F04B 17/05
See application file for complete search history.

(56) References Cited

U.S. PATENT DOCUMENTS 4,488,452 A * 12/1984 Jensen ..... F02B 67/04 123/41 R
6,073,537 A * 6/2000 Noda ..... F02M 41/121 384/907.1
2013/0068064 A1 3/2013 Geyer et al.

FOREIGN PATENT DOCUMENTS

DE 102007006320 8/2008
DE 102010030498 12/2011
(Continued)

OTHER PUBLICATIONS

International Search Report for Application No. PCT/EP2015/066068 dated Nov. 23, 2015 (English Translation, 3 pages).

*Primary Examiner* — Hieu T Vo
(74) *Attorney, Agent, or Firm* — Michael Best & Friedrich LLP

(57) ABSTRACT

A reciprocating pump comprising a roller tappet and a pump plunger that is operatively connected to the roller tappet, wherein the roller tappet has a roller support, a roller and a pin, wherein a first bearing eye and a second bearing eye are formed in the roller support, wherein the pin is mounted in the first bearing eye and in the second bearing eye, wherein the roller is arranged on the pin in a rotatable manner, and wherein the pin is mounted more flexibly in the first bearing eye than in the second bearing eye.

20 Claims, 2 Drawing Sheets

(51) Int. Cl.

| | |
|---|---|
| ***F04B 9/04*** | (2006.01) |
| ***F04B 15/00*** | (2006.01) |
| ***F04B 17/05*** | (2006.01) |

(56) References Cited

FOREIGN PATENT DOCUMENTS

| | | | |
|---|---|---|---|
| DE | 102010063363 | | 6/2012 |
| DE | 102011003678 | | 8/2012 |
| DE | 102011076022 | | 11/2012 |
| JP | H06159191 | A | 6/1994 |
| JP | H06159193 | A | 6/1994 |
| JP | 2009121338 | A | 6/2009 |

* cited by examiner

RECIPROCATING PUMP

BACKGROUND OF THE INVENTION

The present invention relates to a reciprocating pump having a roller tappet.

Such a reciprocating pump is known from the laid-open specification DE 10 2011 076 022 A1. The known reciprocating pump comprises a roller tappet and a pump plunger that is operatively connected to the roller tappet, wherein the roller tappet has a roller support, a roller and a pin. A first bearing eye and a second bearing eye are formed in the roller support, wherein the pin is mounted in the first bearing eye and in the second bearing eye and wherein the roller is arranged on the pin in a rotatable manner.

Under temperature loads, the roller tappet of the known reciprocating pump is subjected to thermal stresses, which can lead to a reduction of the service life, the running smoothness and the degree of efficiency of the reciprocating pump.

SUMMARY OF THE INVENTION

By contrast, the reciprocating pump according to the invention has a roller tappet that is robust with respect to temperature loads. The service life and the degree of efficiency of the reciprocating pump are therefore not reduced as a result of the temperature loads, and a relatively high level of running smoothness of the reciprocating pump is achieved.

For this purpose, the reciprocating pump has a roller tappet and a pump plunger that is operatively connected to the roller tappet. The roller tappet comprises a roller support, a roller and a pin. A first bearing eye and a second bearing eye are formed in the roller support, wherein the pin is mounted in the first bearing eye and in the second bearing eye. The roller is arranged on the pin in a rotatable manner. According to the invention, the pin is mounted more flexibly in the first bearing eye than in the second bearing eye.

On account of the comparatively high flexibility in the first bearing eye or the comparatively low stiffness of the connection between first bearing eye and pin, the pin and the roller support can perform different linear expansions without, in the process, inducing excessive stresses in the components. The stresses on the components, especially under temperature loads, are thus greatly reduced, as a consequence of which the service life of the entire reciprocating pump is correspondingly increased. This also results in the running smoothness and the degree of efficiency of the reciprocating pump being increased.

In an advantageous refinement, the roller support is arranged in a tappet housing. Consequently, it is possible to compensate for tolerances that occur during the transformation of the rotary movement of the roller into a translatory movement of the pump plunger. The roller tappet can therefore orient itself within the tappet housing; stresses which arise due to storage conditions are prevented as a result.

In an advantageous configuration of the invention, the first bearing eye has a first width and the second bearing eye has a second width, wherein the first width is smaller than the second width. Consequently, in a cost-effective configuration, the connection between first bearing eye and pin is embodied in a less stiff manner than the connection between second bearing eye and pin. Furthermore, this also results in the first bearing eye itself being embodied in a less stiff manner than the second bearing eye. The flexibility of the connection between the first bearing eye and pin can therefore compensate for any differing linear expansions of pin and roller support.

In an advantageous refinement, a cutout is formed in the first bearing eye. Due to the cutout, the stiffness of the first bearing eye, and therefore also the stiffness of the connection between first bearing eye and pin, is reduced. Differing linear expansions of pin and roller support can be compensated as a result. The cutout can additionally serve for integrating further functions, for example the supply of lubricant to the first bearing eye.

In an advantageous configuration, the cutout is a reduction of the wall thickness of the first bearing eye. This results in the stiffness of the first bearing eye being reduced in a very simple way. This is a very cost-effective solution, especially for the case in which the roller support is produced by the casting process.

The first bearing eye is advantageously expandable in a flexible manner. The cutout leads as a result to a comparatively large increase in diameter of the first bearing eye, as soon as contact pressure on the pin is present.

In an advantageous embodiment, the cutout is a continuous slot, such that the first bearing eye comprises two bearing legs that are separated from one another on one side. Due to the continuous slot, the first bearing eye is no longer closed over its entire circumference. This leads to a very large reduction of the stiffness of the first bearing eye. As a consequence, the differing linear expansions of roller support and pin can be compensated, even in the case of very large temperature gradients.

In advantageous configurations of the invention, the pin is clamped into the first bearing eye and pressed into the second bearing eye. This means that the surface pressure between first bearing eye and pin is significantly less than the surface pressure between second bearing eye and pin. Thus, in the first bearing eye, the pin can perform relative displacements in relation to the roller support during operation of the reciprocating pump.

In an advantageous refinement, a further cutout is formed in the second bearing eye. As a result, the second bearing eye is also of comparatively soft design and differing linear expansions of roller support and pin can be compensated both in the first bearing eye and in the second bearing eye.

The further cutout is advantageously a reduction of the wall thickness of the second bearing eye. This results in the stiffness of the second bearing eye being reduced in a very simple way. This is a very cost-effective solution, especially for the case in which the roller support is produced by the casting process.

In an advantageous refinement, the pin is clamped into the first bearing eye and into the second bearing eye. Consequently, only a comparatively small contact force on the pin is present, both in the first bearing eye and in the second bearing eye. The pin can perform relative displacements in relation to the roller support, both in the first bearing eye and in the second bearing eye, and can correspondingly compensate for differing thermal expansions of roller support and pin.

In advantageous configurations, the reciprocating pump according to the invention is an integral part of a fuel injection system. High pressures and high temperatures prevail especially in high-pressure pumps of fuel injection systems. The roller tappet of a reciprocating pump that is used as a high-pressure pump is accordingly subjected to large stresses. The reduction or avoidance of thermally induced stresses in the roller tappet accordingly increases not only the service life of the reciprocating pump, but also, along with this, the service life of the entire fuel injection system.

BRIEF DESRIPTION OF THE DRAWINGS

DETAILED DESCRIPTION

Figure 1:
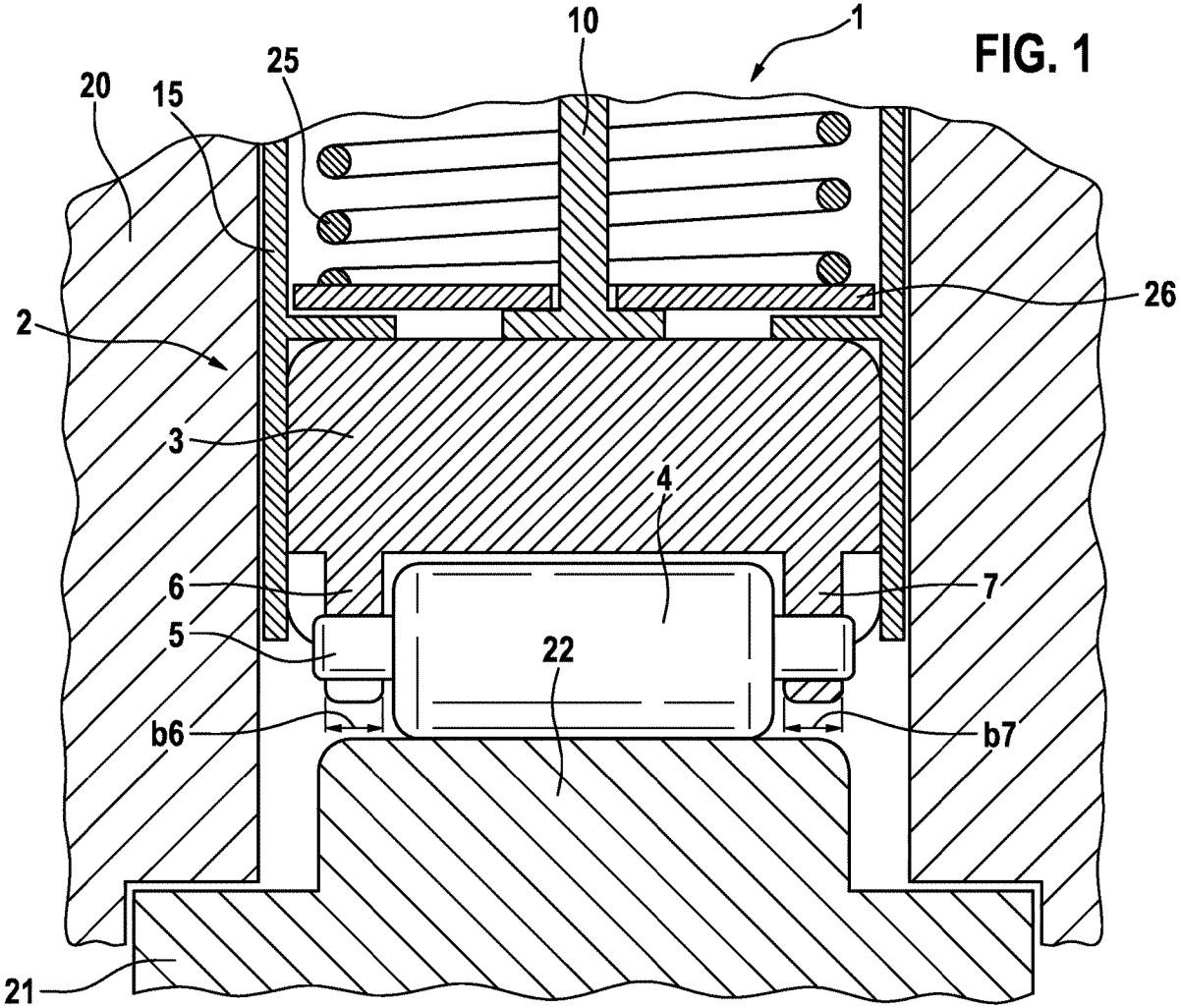
FIG. 1 shows a reciprocating pump having a roller tappet.

FIG. 1 shows a reciprocating pump 1 having a pump housing 20. A camshaft 21, a roller tappet 2 and a pump plunger 10 are arranged in the pump housing 20. The roller tappet 2 comprises a tappet housing 15, a roller support 3, a roller 4 and a pin 5.

The roller support 3 is arranged in the tappet housing 15; in alternative embodiments, the tappet housing 15 and the roller support 3 can also be of one-piece design. The pin 5 is mounted in the roller support 3. For this purpose, a first bearing eye 6 having a first width b6 and a second bearing eye 7 having a second width b7 are formed in the roller support 3, the pin 5 being mounted or pressed into said eyes. The roller 4 is mounted on the pin 5 in a rotatable manner.

A cam 22 formed on the camshaft 21 interacts with the roller 4, such that the roller 4 rolls on the cam 22 whenever there is a rotation of the camshaft 21. On the side opposite to the cam 22, the roller support 3 is operatively connected to the pump plunger 10. A spring 25 pretensions the pump plunger 10, with a shim 26 in between, against the roller support 3.

Figure 2:
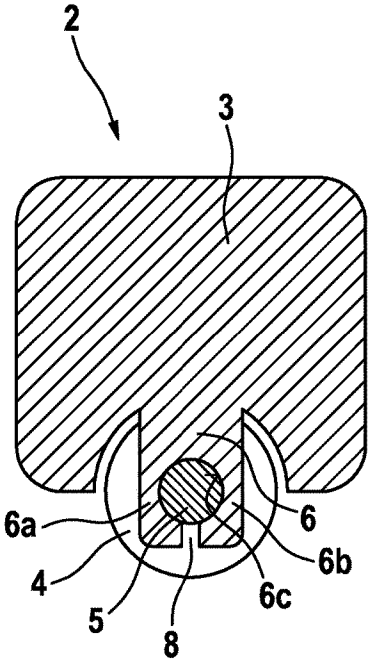
FIG. 2 shows a side view of the roller tappet from FIG. 1.

FIG. 2 shows a side view of the roller tappet 2 from FIG. 1. The side view shows the roller support 3, the roller 4, the pin 5 and the first bearing eye 6. A cutout 8 is formed in the first bearing eye 6. The cutout 8 runs over the entire wall thickness of the first bearing eye 6 in the form of a continuous slot, so that the first bearing eye 6 is divided into a first bearing leg 6*a* and into a second bearing leg 6*b*, wherein the first bearing leg 6*a* is separated from the second bearing leg 6*b* on one side. An inner surface 6*c* of the first bearing eye 6, into which the pin 5 is clamped or pressed, is therefore of comparatively highly flexible design because of the cutout 8.

Figure 3:
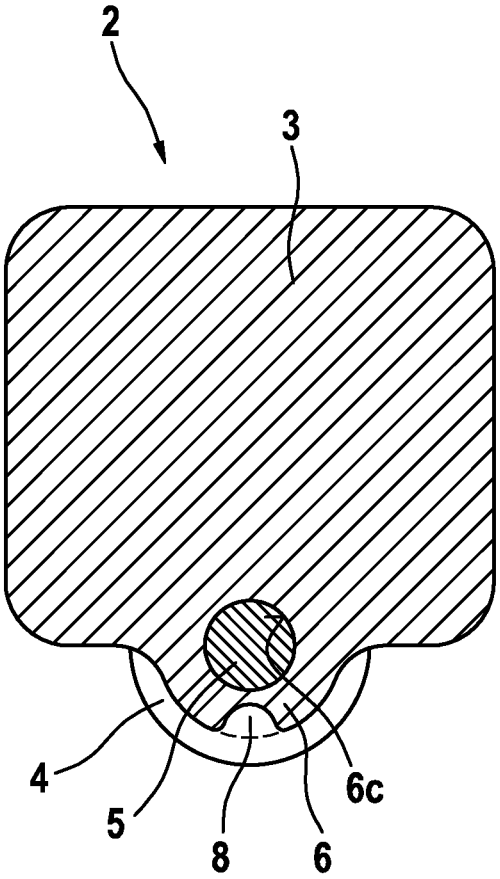
FIG. 3 shows a roller tappet in a further embodiment.

FIG. 3 shows the roller tappet 2 in a further embodiment. In contrast to the embodiment of FIG. 2, the cutout 8 in the first bearing eye 6 is not formed continuously over the entire wall thickness of the first bearing eye 8, but leads solely to a local reduction of the wall thickness of the first bearing eye 6 in this region. Consequently, in this exemplary embodiment, too, the inner surface 6*c* is of flexibly expandable design, that is to say the first bearing eye 6 is of comparatively soft design in the region of the cutout 8.

The reciprocating pump 1 functions as follows:

The camshaft 21 is driven by a drive unit (not shown), for example by a toothed belt connected to a combustion engine. As a result, the cam 22 performs a rotary movement and describes a cam path. The roller tappet 2, which is operatively connected to the cam 22 via the roller 4, performs a translatory upward and downward movement in the pump housing 20 because of the cam path, wherein the direction of the movement runs perpendicularly to the axis of the camshaft 21. Along with the roller tappet 2, the pump plunger 10 also performs the upward and downward movement and thereby compresses a fluid on the side opposite to the roller tappet 2 in a compression chamber (not shown). In this manner it is possible, for example, for the fuel of a fuel injection system to be brought into the reciprocating pump 1 under high pressure.

The reciprocating pump 1 is subjected to temperature variations during operation, which can result in linear expansions of the components. According to the invention, the connection between the pin 5 and the first bearing eye 6 is now of more flexible or softer design than the connection between the pin 5 and the second bearing eye 7. Consequently, under thermal loads, the pin 5 can perform a relative movement in its axial direction in relation to the first bearing eye 6. Thermal stresses in the pin 5 and in the roller support 3 are thus reduced or even avoided.

Here, the differing configurations of the stiffnesses of the connections in the two bearing eyes 6, 7 can be realized, for example, in the following manner:

- The oversize of the two interference fits between the pin 5 and the two bearing eyes 6, 7 is designed to be smaller in the first bearing eye 6 than in the second bearing eye 7.
- The friction force of the interference fit between the pin 5 and the first bearing eye 6 is smaller than the friction force of the interference fit between the pin 5 and the second bearing eye 7, for example, in that the first width b6 is smaller than the second width b7.
- The first bearing eye 6 is of softer design than the second bearing eye 7, for example due to the cutout 8.

The invention claimed is:

1. A reciprocating pump (1) comprising a roller tappet (2) and a pump plunger (10) that is operatively connected to the roller tappet (2), wherein the roller tappet (2) has a roller support (3), a roller (4) and a pin (5), wherein a first bearing eye (6) and a second bearing eye (7) are formed in the roller support (3), wherein the pin (5) is mounted in the first bearing eye (6) and in the second bearing eye (7) and wherein the roller (4) is arranged on the pin (5) in a rotatable manner, characterized in that the pin (5) is mounted more flexibly in the first bearing eye (6) than in the second bearing eye (7).

2. The reciprocating pump as claimed in claim 1, characterized in that the roller support (3) is arranged in a tappet housing (15).

3. The reciprocating pump (1) as claimed in claim 1, characterized in that the first bearing eye (6) has a first width (b6) and the second bearing eye (7) has a second width (b7), wherein the first width (b6) is smaller than the second width (b7).

4. The reciprocating pump (1) as claimed in claim 1, characterized in that a cutout (8) is formed in the first bearing eye (6).

5. The reciprocating pump (1) as claimed in claim 4, characterized in that the cutout (8) is a reduction of the wall thickness of the first bearing eye (6).

6. The reciprocating pump (1) as claimed in claim 4, characterized in that the first bearing eye (6) is expandable in a flexible manner.

7. The reciprocating pump (1) as claimed in claim 4, characterized in that the cutout (8) is a continuous slot, so that the first bearing eye (6) comprises two bearing legs that are separated from one another on one side.

8. The reciprocating pump (1) as claimed in claim 4, characterized in that the pin (5) is clamped into the first bearing eye (6) and pressed into the second bearing eye (7).

9. The reciprocating pump (1) as claimed in claim 4, characterized in that a further cutout is formed in the second bearing eye (7).

10. The reciprocating pump (1) as claimed in claim 9, characterized in that the further cutout is a reduction of the wall thickness of the second bearing eye (7).

11. The reciprocating pump (1) as claimed in claim 9, characterized in that the pin (5) is clamped into the first bearing eye (6) and into the second bearing eye (7).

12. A fuel injection system having a reciprocating pump (1) as claimed in claim 1.

13. The fuel injection system as claimed in claim 12, characterized in that the roller support (3) is arranged in a tappet housing (15).

14. The fuel injection system as claimed in claim 12, characterized in that the first bearing eye (6) has a first width (b6) and the second bearing eye (7) has a second width (b7), wherein the first width (b6) is smaller than the second width (b7).

15. The fuel injection system as claimed in claim 12, characterized in that a cutout (8) is formed in the first bearing eye (6).

16. The fuel injection system as claimed in claim 15, characterized in that the cutout (8) is a reduction of the wall thickness of the first bearing eye (6).

17. The fuel injection system as claimed in claim 15, characterized in that the first bearing eye (6) is expandable in a flexible manner.

18. The fuel injection system as claimed in claim 15, characterized in that the cutout (8) is a continuous slot, so that the first bearing eye (6) comprises two bearing legs that are separated from one another on one side.

19. The fuel injection system as claimed in claim 15, characterized in that the pin (5) is clamped into the first bearing eye (6) and pressed into the second bearing eye (7).

20. The fuel injection system as claimed in claim 15, characterized in that a further cutout is formed in the second bearing eye (7).

* * * * *